US009790055B2

(12) United States Patent
Kere et al.

(10) Patent No.: US 9,790,055 B2
(45) Date of Patent: Oct. 17, 2017

(54) ROPE TERMINAL ASSEMBLY AND AN ELEVATOR

(71) Applicant: KONE Corporation, Helsinki (FI)

(72) Inventors: Petri Kere, Helsinki (FI); Raimo Pelto-Huikko, Vantaa (FI)

(73) Assignee: KONE CORPORATION, Helsinki (FI)

( * ) Notice: Subject to any disclaimer, the term of this patent is extended or adjusted under 35 U.S.C. 154(b) by 410 days.

(21) Appl. No.: 14/485,194

(22) Filed: Sep. 12, 2014

(65) Prior Publication Data

US 2015/0101889 A1 Apr. 16, 2015

(30) Foreign Application Priority Data

Oct. 10, 2013 (EP) ..... 13188103

(51) Int. Cl.

*B66B 7/08* (2006.01)
*B66B 9/00* (2006.01)
*B66B 7/12* (2006.01)

(52) U.S. Cl.

CPC ..... *B66B 7/08* (2013.01); *B66B 7/085* (2013.01); *B66B 9/00* (2013.01); *B66B 7/1223* (2013.01)

(58) Field of Classification Search

CPC ..... B66B 7/08; B66B 7/085; B66B 7/1223; B66B 9/00
USPC ..... 187/412
See application file for complete search history.

(56) References Cited

U.S. PATENT DOCUMENTS 4,043,690 A 8/1977 Browne
4,845,814 A * 7/1989 Crook ..... F16G 11/04 24/135 R
6,026,937 A * 2/2000 Hayashi ..... B66B 11/0226 187/270
6,256,841 B1 * 7/2001 Ericson ..... B66B 7/085 24/136 R
7,578,035 B2 * 8/2009 Dold ..... B66B 7/062 24/136 R
7,607,204 B2 * 10/2009 Ach ..... B66B 7/085 187/411
2002/0042973 A1 * 4/2002 Rivera ..... B66B 7/085 24/115 R
2011/0000746 A1 * 1/2011 Pelto-Huikko ..... B66B 7/062 187/254
2011/0220438 A1 9/2011 Annen et al.
(Continued)

FOREIGN PATENT DOCUMENTS

GB 2255354 A 11/1992

*Primary Examiner* — Michael Riegelman
(74) *Attorney, Agent, or Firm* — Birch, Stewart, Kolasch & Birch, LLP

(57) ABSTRACT

A rope terminal assembly of an elevator fixes an elevator rope to a fixing base such as an elevator unit, said elevator being suitable for transporting passengers and/or goods, which assembly includes at least the following components: an elevator rope, whose width is larger than its thickness in a rope transverse direction, with at least one end having an end face, one or more wedge elements, and a wedge housing, the rope terminal assembly including a rope gap through which said elevator rope passes and said wedge element is arranged to wedge between said rope and said wedge housing thus locking said elevator rope in the gap, and at least one component of the rope terminal assembly made of fiber reinforced polymer composite material, and an elevator.

18 Claims, 4 Drawing Sheets

(56) References Cited

U.S. PATENT DOCUMENTS

| | | | | |
|---|---|---|---|---|
| 2013/0062146 | A1* | 3/2013 | Nolting | B66B 7/062 187/251 |
| 2014/0182975 | A1* | 7/2014 | Ikonen | B66B 5/0031 187/251 |
| 2014/0305744 | A1* | 10/2014 | Kere | B66B 7/1238 187/254 |
| 2015/0151948 | A1* | 6/2015 | Pelto-Huikko | B66B 9/00 187/254 |
| 2015/0307323 | A1* | 10/2015 | Zapf | B66B 7/062 187/411 |
| 2016/0185572 | A1* | 6/2016 | Lehtinen | B66B 7/085 187/411 |
| 2016/0207739 | A1* | 7/2016 | Pelto-Huikko | B66B 7/085 |
| 2016/0272466 | A1* | 9/2016 | Helenius | B66B 5/0031 |

* cited by examiner

ROPE TERMINAL ASSEMBLY AND AN ELEVATOR

FIELD OF THE INVENTION

The object of the invention is a rope terminal assembly of an elevator, the elevator being suitable for transporting passengers and/or goods, and an elevator.

BACKGROUND OF THE INVENTION

In elevator systems, elevator roping is used for suspending and/or moving an elevator car, a counterweight or both. In modern elevators lightweight suspension roping is used, where the elevator roping comprises plural belt-type ropes where the width of the rope is larger than its thickness in a transverse direction of the rope. The rope comprises a load-bearing part made of composite materials, which composite materials comprise non-metallic reinforcing fibers in polymer matrix material. The structure and choice of material make it possible to achieve lightweight elevator ropes having a thin construction in the bending direction, a good tensile stiffness and tensile strength in longitudinal direction. In addition, the rope structure remains substantially unchanged at bending, which contributes towards a long service life.

Several arrangements have been presented to provide tools for attaching elevator ropes with the elevator units. With non-metallic elevator ropes, particularly with elevator ropes made of fiber-reinforced polymer composite materials, it is challenging to make mechanical attachment with the elevator unit without causing damage in the elevator rope.

Components of rope terminal assembly are traditionally constructed from isotropic materials, such as steel, with several parts welded together. Using metallic wedge elements and wedge housing with welded joints have been successfully used in rope terminal assembly to lock the elevator rope in its rope terminal. The drawback of this kind of elevator rope terminal assembly is that it requires a complicated rope terminal wedge housing with several elements joined together by welding. The complicated geometry of the wedge housing with welded joints is not optimal from strength of material point of view.

Furthermore, the elevator roping typically comprises plural ropes, which makes the number of rope terminals needed numerous and hence heavy weight and the production of large amounts of complicated rope terminal products, especially on assembly lines costly. It would be advantageous if the elevator rope terminal could be formed as simple as possible with seamless lightweight wedge housing without multiple elements welded together. There is thus a growing need for cost effective and reliable elevator rope terminal assembly comprising also a connection to the rope condition monitoring means of an elevator.

BRIEF DESCRIPTION OF THE INVENTION

The object of the invention is to introduce an improved rope terminal assembly and an elevator. The object of the invention is, inter alia, to solve drawbacks of known solutions and problems discussed later in the description of the invention. It is also an object to allow a lightweight, cost-effective and reliable rope terminal assembly with faster manufacturing and installation process. The object of the invention is to provide rope terminal assembly with improved quality of manufacturing and installation for the elevator ropes comprising polymer composite materials.

Embodiments are presented which, inter alia, facilitate simple, safe and efficient rope terminal manufacturing process and rope terminal assembly with connection to damage detection of non-metallic load bearing parts in said elevator ropes. Also, embodiments are presented, where rope terminal assembly enables the production of large amounts of rope terminal products, especially on assembly lines of rope terminals in a cost-effective way.

It is brought forward a new rope terminal assembly of an elevator fixing an elevator rope to a fixing base such as an elevator unit, said elevator being suitable for transporting passengers and/or goods, which assembly comprises at least the following components: an elevator rope, whose width is larger than its thickness in a rope transverse direction, with at least one end having an end face, one or more wedge elements, and a wedge housing. The rope terminal assembly comprises a rope gap through which said elevator rope passes and said wedge element is arranged to wedge between said rope and said wedge housing thus locking said elevator rope in the gap. At least one component of the rope terminal assembly is made of fiber reinforced polymer composite material.

In a preferred embodiment, the rope terminal assembly comprises a wedge housing which is a one piece structure of predetermined size made of fiber reinforced polymer composite material. In this way, the wedge housing can be designed to lightweight, structurally stiff and strong pieces in a cost-effective way.

In a preferred embodiment, the rope terminal assembly comprises a wedge housing made from non-metallic polymer composite material comprising reinforcing fibers such as fiberglass or carbon fibers embedded in polymer matrix material, such as epoxy resin, vinylester resin or polyester resin. The wedge housing can hence be made with a higher stiffness-to-weight ratio and strength-to-weight ratio and more lightweight than the metallic wedge housing.

In a preferred embodiment, the wedge housing is constructed by using filament winding method. The wedge housing constructed by using filament winding method is an example of the advantages that fiber-reinforced composite materials offer. Wedge housings are designed with a cylindrical section and a cone-type section with openings at both ends. The relative dimensions of the different sections of the wedge housing are designed according to the space and weight requirements along with the expected stress levels that the wedge housing is expected to withstand. Along with these thickness and length dimensions, the shape of the sections also plays a vital role in the design. This is due to the fact that the sections undergo the highest stress levels and are the most critical locations with regard to failure of the structure. The sections of the wedge housing may comprise metal, e.g. steel or aluminum, or non-metal such as high strength thermoplastic reinforcement ring or inserts to strengthen the composite structure or to protect the composite structure from hole wear.

Using the orthotropic fiber reinforced materials with preferred stiffness and strength directions parallel to the fibers, the ideal shape profile for the wedge housing is round cross-section. The round cross-section implies that all locations within the stressed wedge housing undergo the same level of tensile stress, and the design is formulated so that the major stresses are carried solely by the fibers of the composite. Thus, there is a direct correlation between the wedge housing shape, shell stiffness parameters, and the winding pattern that is used within the manufacturing process. The resulting minimum weight design solution can take into account many particular features of the filament wound wedge housing, such as the size and type of the openings, the method of filament winding such as geodesic or planar winding, and the effect of multiple zones that each possesses different winding angles. The process is completely automated and controlled by specifically designed computer winding programs which ensure that the composite material, a series of laminate plies, is applied accurately in regards to fiber orientation and precise fiber to resin volume for the wedge housing.

In a preferred embodiment, the fiber orientation with respect to the longitudinal axis of the wedge housing is between 0 and ±90 deg, 0 deg fibers producing resistance to longitudinal bend strength and axial tension or compression of the wedge housing, from ±55 deg to ±90 deg fibers producing resistance to internal pressure of the wedge housing, ±45 deg fibers producing resistance to pure torsion load of the wedge housing, and from ±5 deg to ±25 deg fibers producing resistance for bending with torsion. The wedge housing may comprise multiple zones that each possesses different angles for fiber orientation.

In a preferred embodiment, the wedge housing comprises carbon fiber reinforcements embedded in polyimide resin or phenolic resin matrix material. Hence outstanding heat resistance and high strength to weight ratio are achieved for high temperature applications of the rope terminal assembly and an elevator, such as for a fireman's elevator. The fiber reinforced polymer composite wedge housing, particularly polyimide carbon fiber composite wedge housing may be fabricated from prepregs impregnated with resins in organic solvents. For cost savings, the low-cost manufacturing process, such as resin transfer molding can be used as well.

In a preferred embodiment, a component of the rope terminal assembly such as the fiber reinforced polymer composite wedge housing may comprise woven fabric reinforcement such as carbon, E-glass and high strength S-glass fabrics to produce a very high strength and high performance of dimensional stability, heat resistance, fire resistant, thermal conductivity, and chemical resistance.

In a preferred embodiment, the rope terminal assembly comprises a wedge element which is an elongated element comprising a contact surface portion arranged against said wedge housing element and a contact surface portion arranged against said elevator rope surface. The wedge element may comprise a smooth contact surface portion and a rough or patterned contact surface portion, said smooth contact surface portion being arranged against said wedge housing element and said rough or patterned contact surface being arranged against said elevator rope surface. In one embodiment, both contact surface portions have equal contact surfaces. The wedge element may also comprise a space for the rope end block at the first end of the wedge element. The wedge element is advantageously made of metal or of some other mechanically suitable material.

In one embodiment, the rope terminal assembly comprises a wedge element constructed sandwich-structured comprising a core and metal or non-metal skins attached to the core. The sandwich may comprise a metallic or non-metallic core and reinforcing fibers such as fiberglass or carbon fibers in polymer matrix material. The core may comprise metallic such as aluminum honeycomb or non-metallic honeycomb material. Skins of the core may comprise metal or fiber reinforced polymer composite similar used to construct the composite wedge housing. Skins of the core may comprise filaments or woven fabrics embedded in polymer matrix material. The wedge element can hence be made with a higher stiffness-to-weight ratio and strength-to-weight ratio and more lightweight than the metallic wedge element.

In a preferred embodiment, the rope terminal assembly comprises a rope end block attached to said rope end, and said rope end block is attached on said end face side of the elevator rope with respect to the wedge element. The elevator rope is electrically connected to a rope condition monitoring means via said rope end block comprising one or more electrically conductive short circuit elements and fastening means. Also safety of the rope terminal assembly is improved. Said rope end block is used as safety means for the rope terminal assembly. If the elevator rope slips in the rope gap of said rope terminal assembly, the rope end block pushes the wedge element such that the wedge element is arranged to wedge more tightly between said rope and said wedge housing thus locking said elevator rope in the gap.

In a preferred embodiment, the rope terminal assembly comprises a rope end block having first part on a first side of said elevator rope and a second part on a second side of said elevator rope.

In a preferred embodiment, the rope terminal assembly comprises a rope end block extending over said end face of said elevator rope.

In a preferred embodiment, the rope terminal assembly comprises a rope end block of a single piece structure where said first part and a second part of said rope end block are connected with a middle part of said rope end block.

In a preferred embodiment, the rope terminal assembly comprises a rope end block made of plastics or some other electrically non-conductive material.

In a preferred embodiment, the rope terminal assembly comprises an elevator rope electrically connected to a rope condition monitoring means via said rope end block comprising one or more electrically conductive short circuit elements and fastening means.

In a preferred embodiment, the rope terminal assembly comprises an elevator rope comprising non-metallic material such as carbon fiber reinforced polymer composite material.

In a preferred embodiment, the rope terminal assembly comprises an elevator rope comprising one or more fiber reinforced polymer composite load-bearing parts coated with elastomeric material, such as polyurethane or substantially polyurethane based material or silicon or substantially silicon based material. The aforementioned coating provides a medium for transmitting external forces to the load bearing members and a protection for the load bearing members.

In a preferred embodiment, the rope terminal assembly comprises an elevator rope comprising non-metallic such as carbon fiber reinforced polymer composite load bearing parts to which rope condition monitoring means are connected with electrically conductive fastening means.

In a preferred embodiment, elevator ropes with continuous unidirectional untwisted carbon fiber reinforced polymer composite load bearing parts are fixed to the elevator unit with said rope terminal assembly and electrical rope condition monitoring means are connected to the rope via said rope end block of the rope terminal assembly. For unidirectional carbon fiber reinforced polymer composites, the longitudinal electrical resistance of unidirectional fiber is much lower than the transverse resistance, and the damage in the composite material can be detected by measuring the one or the other. Electrical resistance is a good damage sensor for carbon/epoxy laminates, especially for the detection of fiber breakage.

In a preferred embodiment, the elevator roping comprises at least one rope comprising at least one load-bearing member made from carbon fiber reinforced polymer composite material. In a preferred embodiment, each of said at least one load bearing member has width greater than thickness thereof in the width-direction of the rope. In particular, it is preferable that each of said at least one rope is in the form of a belt. Large width makes it well suitable for elevator use as bending of the rope is necessary in most elevators. The rope, in particular the load bearing member(s) thereof, can in this way be given a large cross-sectional area, which facilitates feasible dimensioning of the stiffness of the roping.

In a preferred embodiment, the rope terminal assembly is used in elevators with counterweight, however as well being applicable in elevators without counterweight. In addition, it can also be used in conjunction with other hoisting machines, e.g. as a crane suspension and/or transmission rope. The low weight of the rope provides an advantage especially in acceleration situations, because the energy required by changes in the speed of the rope depends on its mass. The low weight further provides an advantage in rope systems requiring separate compensating ropes, because the need for compensating ropes is reduced or eliminated altogether. The low weight also allows easier handling of the ropes.

In a preferred embodiment of an elevator, said rope terminal assembly according to the invention is used to fix an elevator rope to a fixing base such as the elevator unit or the end of a hoistway. The elevator has been arranged to comprise a hoistway, and an elevator unit movable in the hoistway, the elevator unit being an elevator car for transporting passengers and/or goods.

The elevator arrangement may also comprise other movable elevator units such as the counterweight, as depicted. The elevator comprises lifting means comprising a lifting device, one or more suspension and/or transmission ropes, each said rope comprising one or more load bearing parts, attached with the rope terminal assembly at least to one elevator unit.

In a preferred embodiment each rope is guided to pass over the traction sheave rotated by the hoisting machine of the elevator and one ore more diverting pulleys. As the hoisting machine rotates, the traction sheave at the same time moves the elevator car and the counterweight in the up direction and down direction, respectively, due to friction. In addition, in high-rise buildings and in high-speed elevators there are one or more compensating ropes, each compensating rope being attached at its first end to the bottom end of the counterweight and at its second end to the bottom part of the elevator car, either to the car sling or to the car itself. The compensating rope is kept taut, e.g. by means of compensating pulleys, under which the compensating rope passes around and which pulleys are supported to a support structure on the base of the elevator hoistway. A travelling cable intended for the electricity supply of the elevator car and/or for data traffic, is attached at its first end to the elevator car, e.g. to the bottom part of the elevator car, and at its second end to a connection point on the wall of the elevator hoistway, which connection point is typically at the point of the midpoint or above the midpoint of the height direction of the elevator hoistway.

In a preferred embodiment, the elevator comprises rope condition monitoring means comprising an elevator rope electrically connected to a rope condition monitoring means via said rope end block comprising one or more electrically conductive short circuit elements and fastening means, a rope condition monitoring device, which monitors and transmits an electrical signal of said elevator rope, at predefined time intervals, preferably at least once per second, to an elevator controller. If an error signal is transmitted from said rope condition monitoring means to an elevator controller, the elevator operation is altered or the elevator is taken out of service. In a preferred embodiment, the rope condition monitoring means comprise a current source, a voltage measurement device, a microcontroller, and a display for monitoring condition of said ropes.

In a preferred embodiment, the rope end block is manufactured from plastics or some other electrically non-conductive material. Preferably rope end block is a single piece structure manufactured from plastics, such as from thermoplastics polymer, for instance polyethylene, polypropylene, polystyrene or polyvinyl chloride, or thermosetting polymer, for instance polyester, polyurethanes or epoxy resins. The rope end block may be reinforced by glass, carbon or aramid fibers, and the reinforcing fibers may by short cut or they may be continuous fibers. Hence the mechanical properties, particularly specific strength and stiffness of the rope end block are improved. The rope end block is preferably manufactured by extrusion, pultrusion, injection molding, blow molding, thermoforming, rotational molding, casting, foaming, compression molding or transfer molding, for instance. Thus the manufacturing of rope end block pieces is fast and the manufacturing costs are lower. Said rope end block pieces may also be manufactured from re-cycled plastics or other re-cycled materials.

In a preferred embodiment, the rope end block comprises a first frame portion attached to the elevator rope end and a second frame portion attached to said wedge element. Preferably but not necessary rope end block comprises an elastic portion between said first and second frame portions which elastic portion allows relative movement of said first and second frame portions of said rope end block. Said elastic portion is advantageously located outside of the second frame portion of said rope end block attached to said wedge element.

In a preferred embodiment, the rope end block is attached to said elevator rope end with fastening means. It is thus possible for the fastening means to pass through the openings in the first frame portion of the rope end block. The fastening means can advantageously be made of metal or of some other suitable electrically conductive material. The fastening means are advantageously screws or bolts with nuts. Fastening to the rope can be done by drilling bores in the rope and fastening with screws or bolts. Elasticity of said rope end block can also be arranged by sizing and designing the openings of the first frame portion of the rope end block to have an oval shape, for instance.

In a preferred embodiment, the rope end block is attached to a wedge element with fastening means. It is thus possible for the fastening means to pass through the openings in the second frame portion of the rope end block. The fastening means can advantageously be made of metal or of some other mechanically suitable material. The fastening means are advantageously screws or bolts. The fastening to the wedge element can be done by drilling bores in the wedge element and fastening with screws or bolts.

In a preferred embodiment, the rope end block comprises one or more short circuit elements attached to said rope end block with fastening means. It is thus possible for the fastening means to pass through the openings in the short circuit elements. The short circuit elements as well as the fastening means are advantageously made of metal or of some other suitable electrically conductive material. The fastening means are advantageously screws or bolts. The fastening to the rope is done by drilling bores in the rope and fastening with screws or bolts. The fastening means for attaching short circuit elements are advantageously the same screws or bolts used to attach the rope end block to the rope. In a preferred embodiment, the short circuit elements are metallic short circuit plates.

In a preferred embodiment, the wedge housing comprises two elongated side portions and two elongated wedge support portions, said side portions and said wedge support portions being one piece structure of predetermined size made from a hollow tube-like profile of round cross-section. In a preferred embodiment, the wedge housing element comprises one or more adjustable locking means which are arranged to lock said wedge elements in its position in said wedge housing. It is possible for the locking means to pass through the openings in the wedge housing support elements. The locking means are advantageously screws or bolts. Locking of the wedge elements is done by fastening with screws or bolts. The rope terminal assembly is fixed to the fixing base with a fixing rod being fixed to said wedge housing side elements with fixing means. It is possible for the fixing means of the fixing rod to pass through the openings in the wedge housing side elements. In case of four load-bearing parts, the rope is electrically modeled as four resistors. Preferred solution is to measure one rope as a single resistance. In that way measuring arrangements are kept simple and the method is also more reliable, because the number of wires and connections is minimized. With this method simple and reliable solutions to short-circuit carbon fiber-reinforced-polymer composite load-bearing parts, and to connect the measuring wires to the rope, preferably by self-tapping screws screwed between the load-bearing parts in such a way, that the screw acts as an electrically conductive path between adjacent load-bearing parts, are used. At the counterweight end of said rope, preferably three screws are used to short-circuit all of the strands. At the car end of said rope, preferably two outermost load-bearing parts are connected together, and measuring wires are inserted under these two screws with a split ring connector. With this arrangement, all carbon fiber reinforced polymer load-bearing parts are monitored and the whole rope is seen as a single resistor.

In a preferred embodiment of the invention, at least one rope, but preferably a number of suspension and/or transmission ropes is constructed such that the width of the rope is larger than its thickness in a transverse direction of the rope and fitted to support and move an elevator car, said rope comprising a load-bearing part made of composite material, which composite material comprises non-metal reinforcing fibers such as unidirectional carbon fiber, in a polymer matrix. The suspension rope is most preferably secured by one end to the elevator car and by the other end to a counterweight, but it is applicable for use in elevators without counterweight as well. Although the figures only show elevators with a 1:1 suspension ratio, the rope described is also applicable for use as a suspension rope in an elevator with a 1:2 suspension ratio. The rope is particularly well suited for use as a suspension rope in an elevator having a large lifting height, preferably an elevator having a lifting height of over 100 meters, most preferably 150-800 meters. The rope defined can also be used to implement a new elevator without a compensating rope, or to convert an old elevator into one without a compensating rope.

It is obvious to a person skilled in the art that the invention is not exclusively limited to the embodiments described above, in which the invention has been described by way of example, but that many variations and different embodiments of the invention are possible within the scope of the inventive concept defined in the claims presented below. Thus it is obvious that the ropes described may be provided with a cogged surface or some other type of patterned surface to produce a positive contact with the traction sheave. It is also obvious that the rectangular composite load-bearing parts may comprise edges more starkly rounded than those illustrated or edges not rounded at all. Similarly, the polymer layer of the ropes may comprise edges/corners more starkly rounded than those illustrated or edges/corners not rounded at all. It is likewise obvious that the load-bearing part/parts in the embodiments can be arranged to cover most of the cross-section of the rope. In this case, the sheath-like polymer layer surrounding the load-bearing part/parts is made thinner as compared to the thickness of the load-bearing part, in the thickness-wise direction of the rope. It is likewise obvious that, in conjunction with the solutions represented, it is possible to use belts of other types than those presented. It is likewise obvious that both carbon fiber and glass fiber can be used in the same composite part if necessary. It is likewise obvious that the thickness of the polymer layer may be different from that described. It is likewise obvious that the shear-resistant part could be used as an additional component with any other rope structure showed in this application. It is likewise obvious that the matrix polymer in which the reinforcing fibers are distributed may comprise—mixed in the basic matrix polymer, such as e.g. epoxy—auxiliary materials, such as e.g. reinforcements, fillers, colors, fire retardants, stabilizers or corresponding agents. It is likewise obvious that, although the polymer matrix preferably does not consist of elastomer, the invention can also be utilized using an elastomer matrix. It is also obvious that the fibers have been subjected to sizing or any other surface treatment to improve adhesion to thermoset and to some thermoplastic resins and to protect the fibers. It is also obvious that the fibers need not necessarily be round in cross-section, but they may have some other cross-sectional shape. It is further obvious that auxiliary materials, such as e.g. reinforcements, fillers, colors, fire retardants, stabilizers or corresponding agents, may be mixed in the basic polymer of the layer, e.g. in polyurethane. It is likewise obvious that the invention can also be applied in elevators designed for hoisting heights other than those considered above.

The elevator as describe anywhere above is preferably, but not necessarily, installed inside a building. The car is preferably traveling vertically. The car is preferably arranged to serve two or more landings. The car preferably responds to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

DETAILED DESCRIPTION

Figure 1:
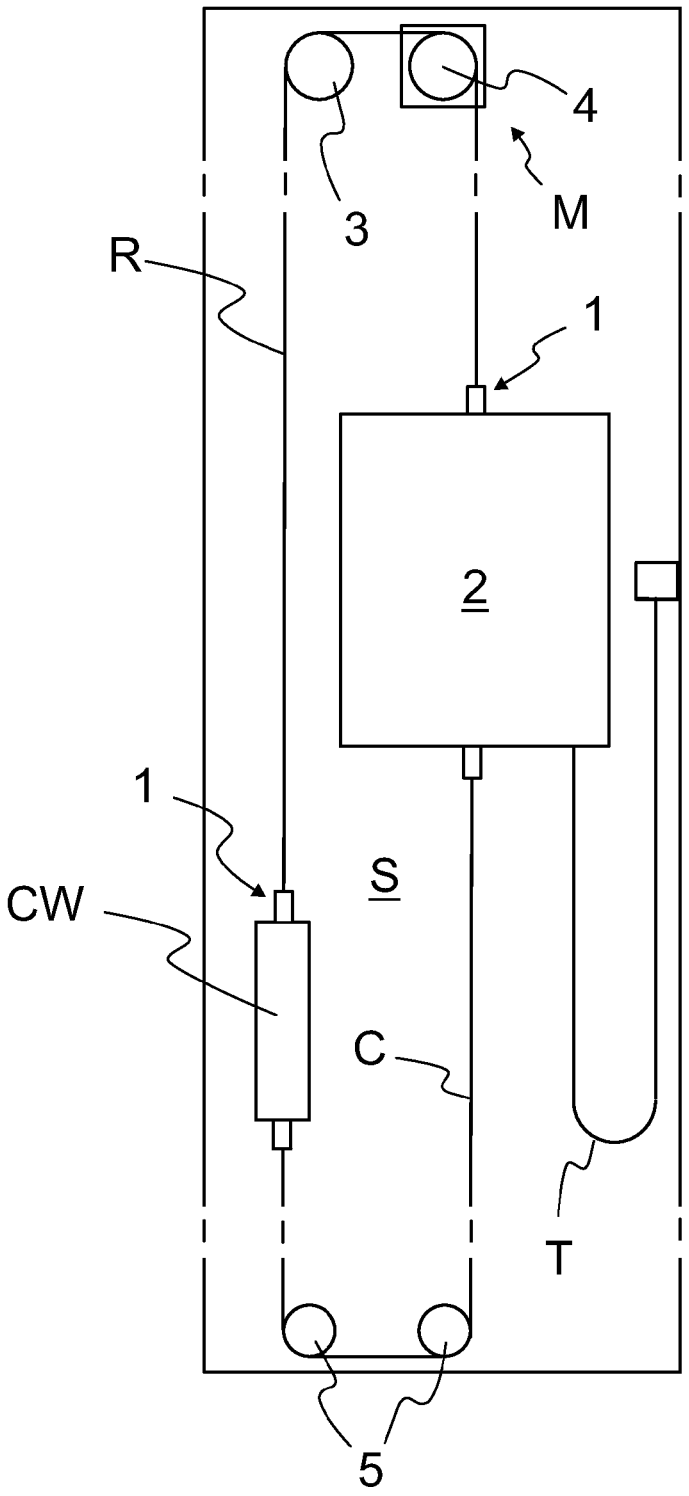
FIG. 1 illustrates schematically an elevator according to an embodiment of the invention.

In FIG. 1 it is illustrated a preferred embodiment of an elevator where the elevator rope R, C is connected to the elevator unit 2, CW with a rope terminal assembly 1 according to the invention. The elevator has been arranged to comprise a hoistway S, and an elevator unit 2 movable in the hoistway S, the elevator unit being an elevator car 2 for transporting passengers and/or goods. The elevator arrangement may also comprise other movable elevator units such as the counterweight CW, as depicted. The elevator comprises lifting means comprising a lifting device M, roping comprising one or more suspension and transmission ropes R, each said rope R comprising one or more load bearing members 11*a*-*d*, 12*a*-*b*, 13 and being attached with the rope terminal assembly 1 at least to one elevator unit 2, CW. Each rope R is guided to pass over the traction sheave 4 rotated by the hoisting machine M of the elevator and one or more diverting pulleys 3. As the hoisting machine M rotates, the traction sheave 4 at the same time moves the elevator car 2 and the counterweight CW in the up direction and down direction, respectively, due to friction. In addition, in high-rise buildings and in high-speed elevators there is a second roping comprising one or more a compensating ropes C, each compensating rope C being suspended to hang at its first end to the bottom end of the counterweight CW and at its second end to the bottom part of the elevator car 2, either to the car sling or to the car itself. The compensating rope C is kept taut, e.g. by means of compensating pulleys 5, under which the compensating rope C passes around and which pulleys 5 are connected to a support structure on the base of the elevator hoistway S, which support structure is not, however, shown in the figure. A travelling cable T intended for the electricity supply of the elevator car and/or for data traffic, e.g., rope condition monitoring data, is suspended to hang at its first end to the elevator car 2, e.g. to the bottom part of the elevator car 2, and at its second end to a connection point on the wall of the elevator hoistway S, which connection point is typically at the point of the midpoint or above the midpoint of the height direction of the elevator hoistway S.

Figure 2:
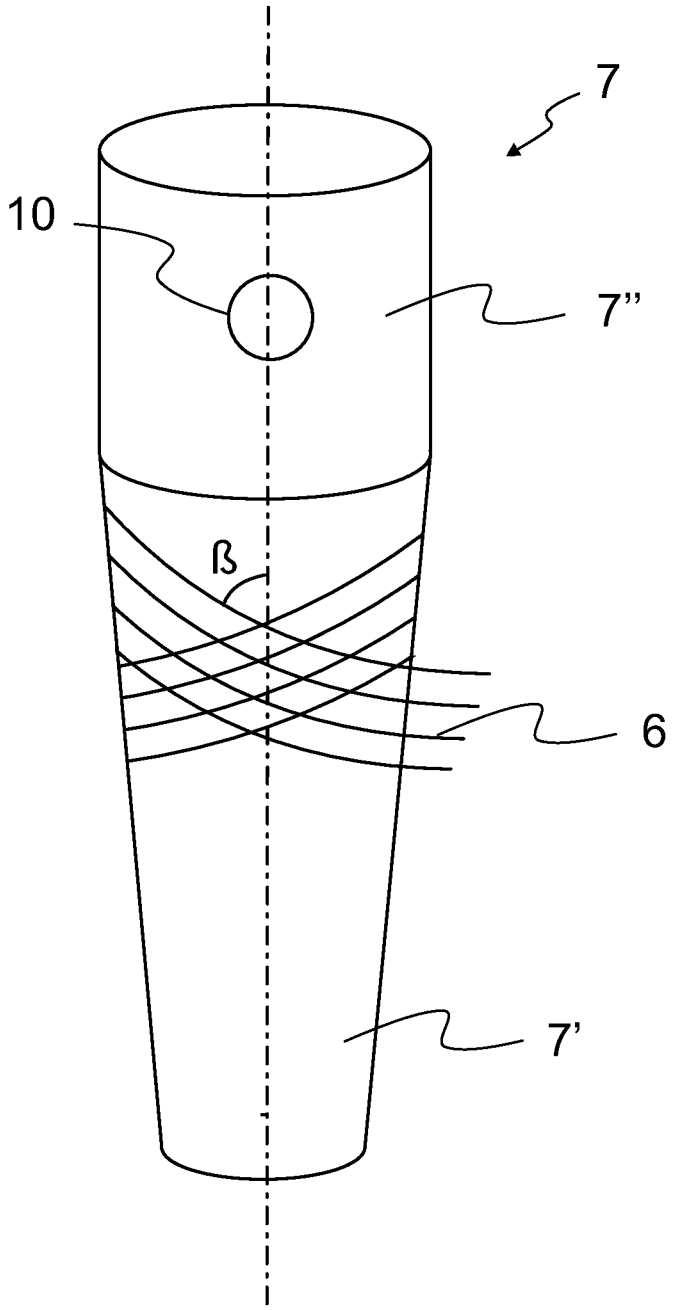
FIG. 2 illustrates schematically a preferred embodiment of a wedge housing manufactured from fiber-reinforced polymer composite material.

FIG. 2 illustrates a preferred embodiment of the wedge housing 7 being a one piece structure of predetermined size made from made from non-metallic polymer composite material comprising reinforcing fibers such as fiberglass or carbon fibers in polymer matrix material. The wedge housing 7 is designed with a cylindrical section 7" and a cone-type section 7' with openings at both ends. The wedge housing 7 is constructed y using filament winding method. The wedge housing 7 geometry is dictated by the mandrel, on which it is formed. Filament winding is a controlled, automated process in which fiber rovings 6 of carbon fiber, fiberglass, or aramids are pulled from large spools through a resinous polymeric material, such as epoxy, and wound upon specially designed wedge housing mandrel tool. For tubular composite fiber wedge housing 7, the mandrel is typically a steel or aluminum cylinder that has a carefully machined outer diameter with a precision ground and polished surface to ensure easy extraction of the composite tube. The wedge housing mandrel tool is held under tension in the filament winding machine and, while the mandrel is spun at precise rates to ensure proper winding, a carriage containing the fiber spools and resin matrix travels back and forth down the length of the mandrel. The process is completely automated and controlled by specifically designed computer winding programs which ensure that the composite material, a series of laminate plies, is applied accurately in regards to fiber orientation β and precise fiber to resin volume for the wedge housing 7.

Once the composite material 6 is applied, a non-stick plastic film is wrapped under tension around the wedge housing 7. The film is applied to provide additional compaction to the composite matrix to ensure wet-out and consolidation and is easily removed following the curing process. The mandrel is placed in a computer-controlled autoclave or oven in which heating profiles harden the polymeric resin, solidifying the composite material. Following the monitored cure, the wound wedge housing 7 is then extracted from the mandrel tool using machinery that protects both the composite and the tooling. The extracted composite wedge housing is then to be processed further to meet all dimensional and other criteria, such as openings 10 for the fixing rod as needed.

Figure 3A:
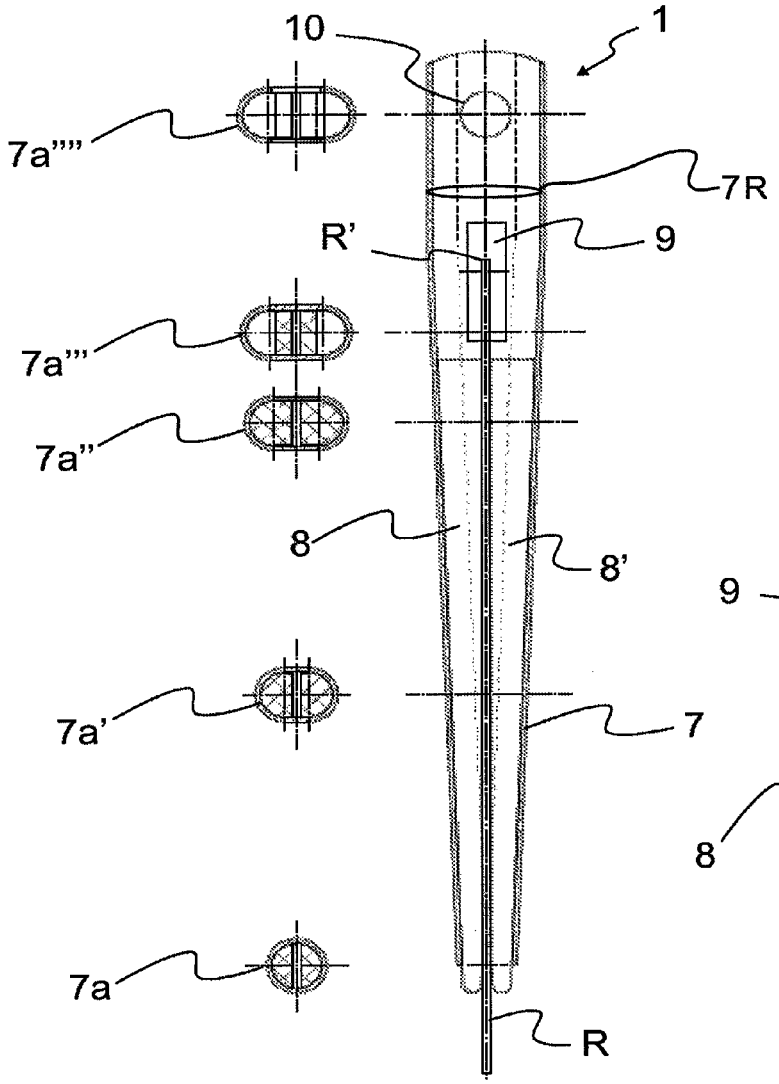
FIG. 3*a* illustrates cross-sections of a preferred embodiment of the rope terminal assembly with two wedge elements and includes a side view of a preferred embodiment of the rope terminal assembly with two wedge elements.

FIG. 3*a* illustrates a preferred embodiment of a rope terminal assembly 1 of an elevator fixing an elevator rope R to a fixing base such as an elevator unit 2, CW, which rope terminal assembly 1 comprises an elevator rope R, whose width is larger than its thickness in a rope transverse direction, with at least one end having an end face R', a rope end block 9 attached to the rope end, two wedge elements 8, 8', and a wedge housing 7. The sections of the wedge housing may comprise metal, e.g. steel or aluminum, or non-metal such as high strength thermoplastic reinforcement rings or inserts 7R to strengthen the composite structure or to protect the composite structure from hole wear. The rope terminal assembly 1 comprises a rope gap through which said elevator rope R passes and said wedge element 8, 8' is arranged to wedge between said rope R and said wedge housing 7, preferably between said rope R and the supporting portions of said wedge housing 7, thus locking said elevator rope in the gap. The rope end block 9 is attached on said end face R' side of the elevator rope R with respect to the wedge element 8, 8'. The left half of FIG. 3*a* illustrates the round-shaped cross-sections 7*a*, 7*a*', 7*a*", 7*a*'", 7*a*"" of the rope terminal assembly 1 with two wedge elements at different points of the longitudinal direction of the wedge housing 7 and the right half of FIG. 3*a* illustrates the side view of the rope terminal assembly 1 with two wedge elements 8, 8'.

The wedge element 8, 8' is an elongated element comprising a smooth contact surface portion and a rough or patterned contact surface portion, said smooth contact surface portion being arranged against said wedge housing 7 and said rough or patterned contact surface being arranged against said elevator rope R surface. The wedge element 8, 8' may also comprise a space for the rope end block 9 at the first end of the wedge element 8, 8'. It is thus possible for the fastening means 91 of the rope end block 9 to be attached to the space of the wedge element 8, 8'. The space for the rope end block 9 is advantageously on the rough or patterned contact surface portion side of the first end of the wedge element 8, 8' and comprises a threaded opening for the fastening means 91. The wedge element 8, 8' is advantageously made of metal or of some other mechanically suitable material.

Said wedge housing 7 may comprise hollows and one or more adjustable locking means 81 which are arranged to lock said wedge elements 8, 8' in its position in said wedge housing 7. It is possible for the locking means 81 to pass through the openings in the wedge housing 7. The locking means 81 are advantageously screws or bolts. The rope terminal assembly 1 is fixed to the fixing base with a fixing rod 10 being fixed to said side of the wedge housing 7 with fixing means. It is possible for the fixing means of the fixing rod to pass through the openings 10 in the wedge housing 7.

The elevator comprises rope condition monitoring means comprising an elevator rope R electrically connected to a rope condition monitoring means via said rope end block 9 comprising one or more electrically conductive short circuit elements and fastening means 91, a rope condition monitoring device, which monitors and transmits an electrical signal of said elevator rope, at predefined time intervals, preferably at least once per second, to an elevator controller. If an error signal is transmitted from said rope condition monitoring means to an elevator controller, the elevator operation is altered or the elevator is taken out of service. In a preferred embodiment, the rope condition monitoring means comprise a current source, a voltage measurement device, a microcontroller, and a display for monitoring condition of said ropes R.

Rope end block 9 is attached to the elevator rope R end with fastening means 91. It is thus possible for the fastening means 91 to pass through the openings in the frame portion of the rope end block 9. The fastening means 91 can advantageously be made of metal or of some other suitable electrically conductive material. The fastening means are advantageously screws or bolts with nuts. The fastening to the rope R can be done by drilling bores in the rope R and fastening with screws or bolts. Elasticity of said rope end block 9 can also be arranged by sizing and designing the openings of the frame portion of the rope end block 9 to have an oval shape, for instance. The rope end block 9 comprises one or more short circuit elements attached to the rope end block 9 with fastening means 91. It is thus possible for the fastening means to pass through the openings in the short circuit elements. The short circuit elements such as short circuit plates as well as the fastening means are advantageously made of metal or of some other suitable electrically conductive material. Rope end block 9 is manufactured from plastics or some other electrically non-conductive material. Preferably rope end block 9 is a single piece structure manufactured from plastics, preferably from thermoplastics polymer or thermosetting polymer.

In preferred embodiment, the rope condition monitoring means is used to measure electrical resistance between a first point and a second point of said elevator rope R, C first time during elevator installation and second time when said elevator is used for transporting passenger and/or goods. Preferably said first point and second point are points of a non-metallic load bearing part 11*a-d*, 12*a-b*, 13 of the elevator rope R, C, or points of several electrically connected non-metallic load bearing parts 11*a-d*, 12*a-b*, 13 of said elevator rope R, C.

Figure 3B:
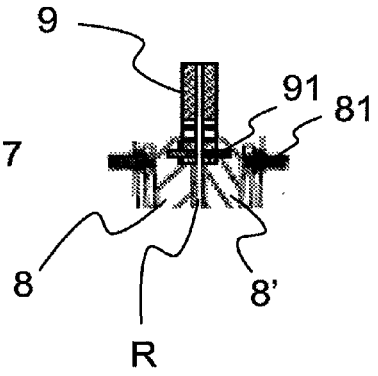
FIG. 3*b* illustrates a preferred embodiment of the rope end block.
Figure 4A:
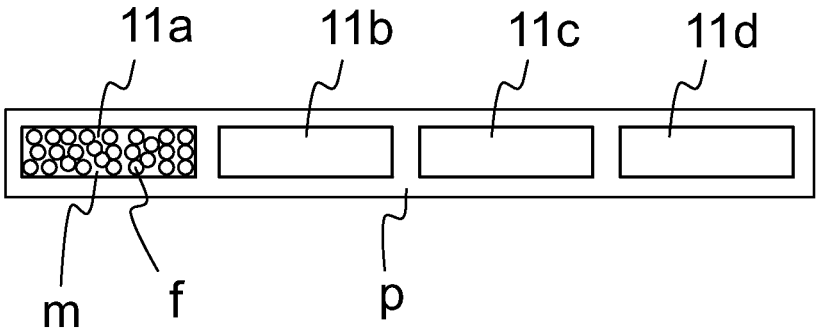
FIGS. 4*a*-4*c* illustrates the preferred alternative cross-sections for the elevator rope.
Figure 4B:
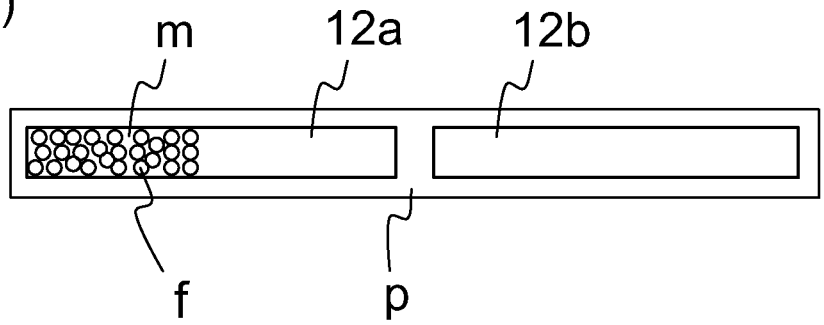
Figure 4C:
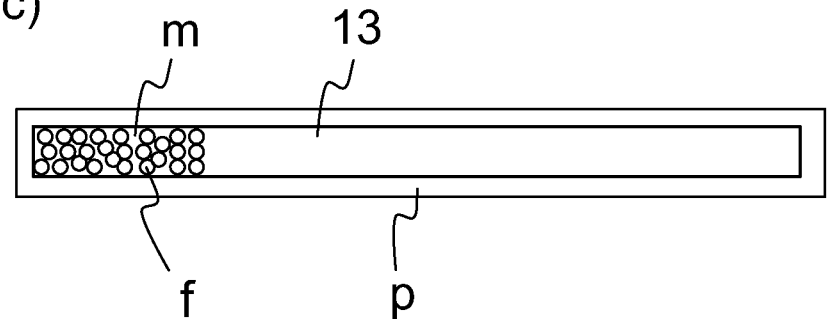

FIGS. 4*a*, 4*b* and 4*c* illustrates a preferred embodiment of a rope R cross section with four load-bearing parts 11*a-d*, two load-bearing parts 12*a-b*, and one load-bearing part 13, respectively, as described in connection with one of FIGS. 1 and 3 used as a suspension and/or transmission rope R of an elevator, particularly a passenger elevator. In the use according to the invention, at least one rope R, but preferably a number of ropes R is constructed such that the width of the rope is larger than its thickness in a transverse direction of the rope R and fitted to support and move an elevator car, said rope R comprising a load-bearing part 11*a-d*, 12*a-b*, 13 made of composite material, which composite material comprises reinforcing fibers f, which consist of untwisted unidirectional carbon fibers, in a polymer matrix m oriented in the lengthwise direction of the rope. The suspension rope R is most preferably secured by one end to the elevator car 1 and by the other end to a counterweight CW, but it is applicable for use in elevators without counterweight as well. Although the figures only show elevators with a 1:1 suspension ratio, the rope R described is also applicable for use as a suspension rope R in an elevator with a 1:2 suspension ratio. The rope R is particularly well suited for use as a suspension and transmission rope R in an elevator having a large lifting height, preferably an elevator having a lifting height of over 100 meters, most preferably 150-800 meters. The rope R defined can also be used to implement a new elevator without a compensating rope C, or to convert an old elevator into one without a compensating rope C.

As presented in the FIGS. 4*a*-4*c*, the rope R is in the form of a belt, and thereby has a width substantially larger than the thickness thereof. This makes it well suitable for elevator use as bending of the rope is necessary in most elevators. So as to enable turning radius well suitable for elevator use, it is preferable that the width/thickness ratio of the rope is at least 2 or more, preferably at least 4, even more preferably at least 5 or more. So as to enable turning radius well suitable for elevator use, it is preferable that the width/thickness ratio(s) of said force transmission part(s) is/are at least 2, preferably at least 3 or more. When the rope R is made to contain only one load bearing member 13, then it is preferable that the ratio is 5 or more. It is preferable, that all the load bearing member(s) 11*a-d*, 12*a-b*, 13 of the rope R (irrespective whether there is only one or more of them in the rope) cover together majority, preferably 70% or over, more preferably 75% or over, most preferably 80% or over, of the width of the rope. Thus, the width of the rope is effectively utilized for the function of load bearing.

In the embodiment as illustrated in FIG. 4*a* and FIG. 4*b*, the rope R comprises a plurality of load bearing members 11*a-d*, 12*a-b*. These plural load bearing members 11*a-d*, 12*a-b* are placed adjacent each other in the width direction of the belt and on the same plane. In the embodiment as illustrated in FIG. 4*c*, the rope R comprises only one load bearing member 13. In both of these embodiments, the load bearing member(s) 11*a-d*, 12*a-b*, 13 is/are surrounded with a layer p, which layer p forms the surface of the rope protecting the load bearing member(s) 11*a-d*, 12*a-b*, 13. The layer p is preferably of polymer, most preferably of elastic polymer, such as of polyurethane, as it provides good wear resistance, protection and good friction properties, for instance for frictional traction contact with the rope wheel 4. In both of these embodiments, the load bearing member(s) 11*a-d*, 12*a-b*, 13 have a width larger than the thickness thereof as measured in width-direction of the rope R.

In this application, the term load bearing member of a rope refers to the part that is elongated in the longitudinal direction of the rope, and which part is able to bear without breaking a significant part of the load exerted on the rope in question in the longitudinal direction of the rope. The aforementioned load exerted on the rope causes tension on the load bearing member in the longitudinal direction of the load bearing member, which tension can be transmitted inside the load bearing member in question all the length of the load bearing member, e.g. from one end of the load bearing member to the other end of it.

It is obvious to a person skilled in the art that the invention is not exclusively limited to the embodiments described above, in which the invention has been described by way of example, but that many variations and different embodiments of the invention are possible within the scope of the inventive concept defined in the claims presented below. Thus it is obvious that the ropes R described may be provided with a cogged surface or some other type of patterned surface to produce a positive contact with the traction sheave 4. It is also obvious that the rectangular composite load-bearing parts 11*a-d*, 12*a-b*, and 13 may comprise edges more starkly rounded than those illustrated or edges not rounded at all. Similarly, the polymer layer p of the ropes R may comprise edges/corners more starkly rounded than those illustrated or edges/corners not rounded at all. It is likewise obvious that the load-bearing part/parts 11*a-d*, 12*a-b*, and 13 in the embodiments can be arranged to cover most of the cross-section of the rope R. In this case, the sheath-like polymer layer p surrounding the load-bearing part/parts 11*a-d*, 12*a-b*, and 13 is made thinner as compared to the thickness of the load-bearing part 11*a-d*, 12*a-b*, and 13 in the thickness-wise direction of the rope R. It is likewise obvious that, in conjunction with the solutions represented by figures, it is possible to use belts of other types than those presented. It is likewise obvious that both carbon fiber and glass fiber can be used in the same composite part if necessary. It is likewise obvious that the thickness of the polymer p layer may be different from that described. It is likewise obvious that the shear-resistant part could be used as an additional component with any other rope structure showed in this application. It is likewise obvious that the matrix polymer in which the reinforcing fibers f are distributed may comprise—mixed in the basic matrix polymer, such as e.g. epoxy—auxiliary materials, such as e.g. reinforcements, fillers, colors, fire retardants, stabilizers or corresponding agents. It is likewise obvious that, although the polymer matrix preferably does not consist of elastomer, the invention can also be utilized using an elastomer matrix. It is also obvious that the fibers f need not necessarily be round in cross-section, but they may have some other cross-sectional shape. It is further obvious that auxiliary materials, such as e.g. reinforcements, fillers, colors, fire retardants, stabilizers or corresponding agents, may be mixed in the basic polymer of the layer p, e.g. in polyurethane. It is likewise obvious that the invention can also be applied in elevators designed for hoisting heights other than those considered above.

It is to be understood that the above description and the accompanying figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. A rope terminal assembly of an elevator for fixing an elevator rope to a fixing base, the rope terminal assembly comprising:

the elevator rope, whose width is larger than its thickness in a rope transverse direction, with at least one end having an end face;

one or more wedge elements; and a wedge housing, wherein the rope terminal assembly comprises a rope gap through which said elevator rope passes and said wedge element is arranged to wedge between said rope and said wedge housing thus locking said elevator rope in the gap, and at least one component of the rope terminal assembly is made of fiber reinforced polymer composite material, and wherein said wedge housing comprises reinforcing fibers in multiple zones, each zone possesses different angles for fiber orientation.

2. The rope terminal assembly according to claim 1, wherein said wedge housing is a one piece structure of predetermined size with a round cross section.

3. The rope terminal assembly according to claim 2, wherein said wedge housing comprises fiberglass or carbon fibers embedded in a polymer matrix material.

4. The rope terminal assembly according to claim 2, wherein said wedge housing comprises reinforcing fibers having various fiber orientations with respect to the longitudinal axis of the wedge housing.

5. The rope terminal assembly according to claim 1, wherein said wedge housing comprises reinforcing fibers.

6. The rope terminal assembly according to claim 5, wherein the reinforcing fibers have various fiber orientations with respect to the longitudinal axis of the wedge housing.

7. The rope terminal assembly according to claim 1, wherein said wedge housing comprises reinforcing fibers having various fiber orientations with respect to the longitudinal axis of the wedge housing.

8. The rope terminal assembly according to claim 1, wherein one or more sections of said wedge housing comprises a metal or non-metal reinforcement ring or insert.

9. The rope terminal assembly according to claim 1, wherein one or more components of the rope terminal assembly is constructed using filament winding method, resin transfer molding method or fabricated from prepregs.

10. The rope terminal assembly according to claim 1, wherein one or more components of the rope terminal assembly comprises carbon fiber reinforcements embedded in polyimide resin or phenolic resin matrix material.

11. The rope terminal assembly according to claim 1, wherein said wedge element is an elongated element comprising a contact surface portion arranged against said wedge housing element and arranged against said elevator rope surface.

12. The rope terminal assembly according to claim 1, wherein said wedge element is constructed sandwich-structured comprising a core and metal or non-metal skins attached to the core.

13. The rope terminal assembly according to claim 1, wherein said assembly comprises a rope end block attached to said rope end, and said rope end block is attached on said end face side of the elevator rope with respect to the wedge element.

14. The rope terminal assembly according to claim 1, wherein said rope end block is made from plastics or some other electrically non-conductive material.

15. The rope terminal assembly according to claim 1, wherein said elevator rope is electrically connected to a rope condition monitoring means via said rope end block comprising one or more electrically conductive short circuit elements and a fastener.

16. The rope terminal assembly according to claim 1, wherein said elevator rope comprises one or more non-metallic such as carbon fiber reinforced polymer composite load bearing parts.

17. An elevator suitable for transporting passengers and/or goods, which elevator comprises:

a hoistway;

at least one elevator unit movable in the hoistway, including:

at least an elevator car;

a lifting mechanism comprising a lifting device; and the rope terminal assembly of claim 1, wherein said elevator rope is fixed to the at least one elevator car via the rope terminal assembly.

18. The rope terminal assembly according to claim 1, wherein said wedge housing comprises fiberglass or carbon fibers embedded in polymer matrix material.

* * * * *